US008522735B2

(12) United States Patent
Sakayanagi et al.

(10) Patent No.: US 8,522,735 B2
(45) Date of Patent: Sep. 3, 2013

(54) VALVE STOPPING DEVICE FOR INTERNAL COMBUSTION ENGINE

(75) Inventors: Yoshihiro Sakayanagi, Gotenba (JP); Shigeki Miyashita, Susono (JP)

(73) Assignee: Toyota Jidosha Kabushiki Kaisha, Tokyo (JP)

( * ) Notice: Subject to any disclaimer, the term of this patent is extended or adjusted under 35 U.S.C. 154(b) by 109 days.

(21) Appl. No.: 13/146,871

(22) PCT Filed: May 11, 2009

(86) PCT No.: PCT/JP2009/058776

§ 371 (c)(1),
(2), (4) Date: Jul. 28, 2011

(87) PCT Pub. No.: WO2010/131325

PCT Pub. Date: Nov. 18, 2010

(65) Prior Publication Data

US 2011/0277710 A1 Nov. 17, 2011

(51) Int. Cl.
*F01L 1/34* (2006.01)

(52) U.S. Cl.
USPC ..... 123/90.15; 123/90.11; 701/105

(58) Field of Classification Search
USPC ..... 123/90.15, 90.17, 347, 90.11; 701/105
See application file for complete search history.

(56) References Cited

U.S. PATENT DOCUMENTS

| | | | | |
|---|---|---|---|---|
| 5,983,847 | A | 11/1999 | Miyoshi et al. | |
| 8,108,122 | B2 * | 1/2012 | Ezaki | 701/103 |

FOREIGN PATENT DOCUMENTS

| | | | |
|---|---|---|---|
| JP | 9-060513 | A | 3/1997 |
| JP | 2000-027613 | A | 1/2000 |
| JP | 2001-317318 | A | 11/2001 |
| JP | 2004-019616 | A | 1/2004 |
| JP | 2004-270596 | A | 9/2004 |
| JP | 2004-270627 | A | 9/2004 |
| JP | 2006-194252 | A | 7/2006 |
| JP | 2008-180230 | A | 8/2008 |
| JP | 2008-223542 | A | 9/2008 |
| WO | 2006/098133 | A1 | 9/2006 |

* cited by examiner

*Primary Examiner* — Ching Chang
(74) *Attorney, Agent, or Firm* — Sughrue Mion, PLLC

(57) ABSTRACT

Disclosed is a valve stopping device for an internal combustion engine that does not allow valves for all cylinders to stop in the closed state even in the event of a failure.
The valve stopping device includes a control device 2 and a plurality of actuators 4A, 4B, 4C, 4D, which stop either an intake valve or an exhaust valve. The actuators 4A, 4D for some of a plurality of cylinders included in the internal combustion engine stop a valve in the closed state when energized. The actuators 4B, 4C for the remaining cylinders stop a valve in the closed state when energized. The control device 2 provides control on an individual actuator basis to determine whether or not to energize the actuators 4A, 4B, 4C, 4D.

2 Claims, 5 Drawing Sheets

Fig. 9

| | 360°CA | 540°CA | 0°CA | 180°CA | 360°CA |
|---|---|---|---|---|---|
| CYLINDER A | INTAKE | COMPRESSION | EXPANSION | EXHAUST | |
| CYLINDER B | EXPANSION | EXHAUST | INTAKE | COMPRESSION | |
| ENERGIZATION | OFF | | ON | | |

Fig. 10

| | 360°CA | 540°CA | 0°CA | 180°CA | 360°CA |
|---|---|---|---|---|---|
| CYLINDER A | ~~INTAKE~~ | COMPRESSION | EXPANSION | EXHAUST | |
| CYLINDER B | EXPANSION | EXHAUST | ~~INTAKE~~ | COMPRESSION | |
| ENERGIZATION | ON | | OFF | | |

Fig. 11

| | 360°CA | 540°CA | 0°CA | 180°CA | 360°CA |
|---|---|---|---|---|---|
| CYLINDER A | ~~INTAKE~~ | COMPRESSION | EXPANSION | EXHAUST | |
| CYLINDER B | EXPANSION | EXHAUST | INTAKE | COMPRESSION | |
| ENERGIZATION | ON | | | | |

Fig. 12

| | 360°CA | 540°CA | 0°CA | 180°CA | 360°CA |
|---|---|---|---|---|---|
| CYLINDER A | INTAKE | COMPRESSION | EXPANSION | EXHAUST | |
| CYLINDER B | EXPANSION | EXHAUST | ~~INTAKE~~ | COMPRESSION | |
| ENERGIZATION | OFF | | | | |

VALVE STOPPING DEVICE FOR INTERNAL COMBUSTION ENGINE

CROSS REFERENCE TO RELATED APPLICATION

This application is a National Stage of International Application No. PCT/JP2009/058776 filed May 11, 2009, the contents of all of which are incorporated herein by reference in their entirety.

TECHNICAL FIELD

The present invention relates to a valve stopping device for an internal combustion engine that is used as an automotive power unit, and more particularly to a valve stopping device that is used with a multi-cylinder internal combustion engine to stop valves on an individual cylinder basis or on an individual cylinder group basis.

BACKGROUND ART

There is a well-known valve stopping device that can stop either an intake valve or an exhaust valve of an internal combustion engine in a closed state. The valve stopping device includes an actuator for stopping a valve and a control device for controlling the actuator. Various mechanical schemes or electrical schemes were proposed for the actuator included in the valve stopping device. However, the actuator is generally configured so that an electrical signal input from the control device is used to control an actuator operation for stopping a valve or making it operative. A device disclosed, for instance, in JP-A-2001-317318 stops a valve or makes it operative by allowing an electrically-driven solenoid to manipulate a coupling pin and change the coupled state of a rocker arm that is divided into a plurality of segments.

When the valve stopping device stops a valve in the closed state, a cylinder provided with the valve comes to a halt. When the valve stopping device is incorporated in an internal combustion engine having a plurality of cylinders, it can make all the cylinders operative or some of the cylinders operative by controlling a valve stopping device operation in such a manner as to stop valves or make them operative on an individual cylinder basis or on an individual cylinder group basis. As fuel efficiency is improved by changing the number of operative cylinders in accordance with load and engine speed, great benefits are achieved when the valve stopping device is incorporated in the internal combustion engine.

However, when the valve stopping device is to be incorporated in the internal combustion engine, consideration should be given to failure of the valve stopping device. If the valve stopping device becomes faulty for some reason, the valves cannot be stopped, cannot be made operative, or may be erroneously stopped. The valve stopping device may become faulty due to either the failure of an individual actuator or the failure of the control device. However, a more serious consequence occurs when the control device becomes faulty. When the control device is faulty, an electrical signal to be output to the actuator for each cylinder may stay on or stay off. In such an instance, the valves for all cylinders may be erroneously stopped to bring the entire internal combustion engine to a stop. If a signal to be output to the solenoid of the device disclosed, for instance, in JP-A-2001-317318 stays on due to a fault in the control device, the valves for all cylinders are stopped to make the internal combustion engine inoperative. When the internal combustion engine is inoperative, it is obvious that a vehicle using the internal combustion engine as its power unit is unable to run.

SUMMARY OF THE INVENTION

The present invention has been made in view of the above circumstances, and provides a valve stopping device for an internal combustion engine that does not allow the valves for all cylinders to stop in the closed state even in the event of a failure.

The valve stopping device according to the present invention is capable of stopping either an intake valve or an exhaust valve of an internal combustion engine having a plurality of cylinders on an individual cylinder basis or on an individual cylinder group basis. The valve stopping device according to a first aspect of the present invention includes actuators for stopping either an intake valve or an exhaust valve, and a control device for providing control to determine whether or not to energize the actuators. The actuators include an actuator (hereinafter referred to as the type 1 actuator) that stops a valve in the closed state when energized; and an actuator (hereinafter referred to as the type 2 actuator) that stops a valve in the closed state when de-energized. Some of the cylinders included in the internal combustion engine are provided with the type 1 actuator. The remaining cylinders are provided with the type 2 actuator. Preferably, one half of the cylinders are provided with the type 1 actuator while the remaining half of the cylinders are provided with the type 2 actuator. The control device provides control on an individual actuator basis to determine whether or not to energize the actuators.

The valve stopping device according to a second aspect of the present invention includes actuators for stopping either an intake valve or an exhaust valve, and a control device for providing control to determine whether or not to energize the actuators. The actuators include a type 1 actuator and a type 2 actuator. Energizing the type 1 actuator for a predetermined valve stop instruction period stops a valve in the closed state. De-energizing the type 2 actuator for a predetermined valve stop instruction period stops a valve in the closed state. The valve stop instruction period for an actuator is determined in accordance with its relationship to the crank angle of a cylinder for which the actuator is provided. Some of the cylinders included in the internal combustion engine are provided with the type 1 actuator. The remaining cylinders are provided with the type 2 actuator. Preferably, the number of cylinders for which the type 1 actuator is provided is the same as the number of cylinders for which the type 2 actuator is provided. One signal line is shared by a type 1 actuator and a type 2 actuator whose valve stop instruction periods do not overlap with each other. The control device provides control on an individual shared signal line basis to determine whether or not to energize the actuators.

Even if the electrical signal to be output to each actuator from the control device stays on or stays off due to a fault in the control device, the present invention prevents the valves for all cylinders from being stopped in the closed state. More specifically, if the output signal of the control device stays on due to a fault, the valves for a cylinder for which the type 1 actuator is provided are erroneously stopped. However, the valves for a cylinder for which the type 2 actuator is provided are allowed to remain operative. In this instance, therefore, the cylinder for which the type 2 actuator is provided enables the internal combustion engine to operate continuously. Thus, the vehicle will not be unable to run. If, in contrast, the output signal of the control device stays off due to a fault, the valves for a cylinder for which the type 2 actuator is provided are erroneously stopped. However, the valves for a cylinder for which the type 1 actuator is provided are allowed to remain operative. In this instance, therefore, the cylinder for which the type 1 actuator is provided enables the internal combustion engine to operate continuously. Thus, the vehicle will not be unable to run.

BRIEF DESCRIPTION OF DRAWINGS

FIG. 9 is an illustration of the valve stopping device shown in FIG. 8 which indicates the output signal settings of a control device to make both cylinders A, B operative.

FIG. 10 is an illustration of the valve stopping device shown in FIG. 8 which indicates the output signal settings of a control device to stop both cylinders A, B.

FIG. 11 is an illustration of the valve stopping device shown in FIG. 8 which indicates the output signal settings of a control device to stop only cylinder A.

FIG. 12 is an illustration of the valve stopping device shown in FIG. 8 which indicates the output signal settings of a control device to stop only cylinder B.

MODE FOR CARRYING OUT THE INVENTION

First Embodiment

A first embodiment of the present invention will now be described with reference to FIGS. 1 to 7.

Figure 1:
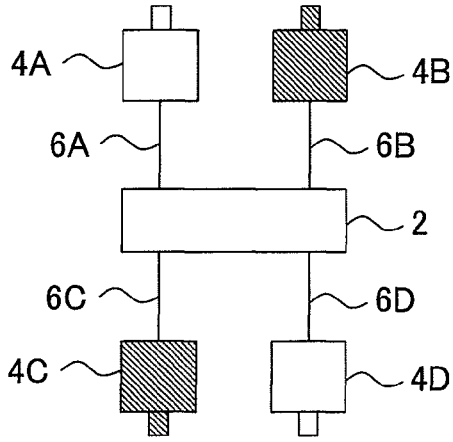
FIG. 1 is a schematic diagram illustrating a configuration of a valve stopping device for an internal combustion engine according to a first embodiment of the present invention.

A valve stopping device according to the present invention is applied to a four-stroke internal combustion engine having a plurality of cylinders. In the first embodiment, the present invention is applied to a four-cylinder internal combustion engine that is used as an automotive power unit. FIG. 1 is a schematic diagram illustrating a configuration of the valve stopping device according to the present embodiment. The valve stopping device includes a control device 2 and four actuators 4A, 4B, 4C, 4D, which are respectively provided for four cylinders. The actuators 4A, 4B, 4C, 4D are connected to the control device 2 through their own signal lines 6A, 6B, 6C, 6D. The control device 2 outputs signals to the actuators 4A, 4B, 4C, 4D through the signal lines 6A, 6B, 6C, 6D for the purpose of providing control to determine whether or not to energize the actuators 4A, 4B, 4C, 4D.

The actuators 4A, 4B, 4C, 4D include a mechanical or electrical scheme that can stop either an intake valve or an exhaust valve in the closed state. As the scheme is not specifically defined, it will not be described here. However, the actuators are divided into two types. The actuators 4A, 4D stop a valve in the closed state when energized, whereas the actuators 4B, 4C stop a valve in the closed state when de-energized. The former actuators are referred to as the type 1 actuators, whereas the latter actuators are referred to as the type 2 actuators.

Figure 2:
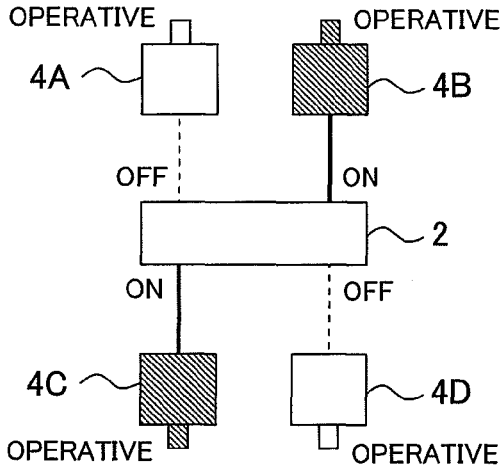
FIG. 2 is an illustration of the valve stopping device shown in FIG. 1 which indicates the output signal settings of a control device to make all cylinders operative and the operating states of each actuator of this case.

The control device 2 changes the number of operative cylinders of the internal combustion engine by providing control to determine whether or not energize the actuators 4A, 4B, 4C, 4D in accordance with the load and engine speed of the internal combustion engine or other demands. FIG. 2 depicts the case where all cylinders are operative and indicates the output signal settings of the control device 2 and the operating states of the actuators 4A, 4B, 4C, 4D. In this case, the signals to be output to the type 1 actuators 4A, 4D are off, whereas the signals to be output to the type 2 actuators 4B, 4C are on. This setup makes all cylinder valves operative.

Figure 3:
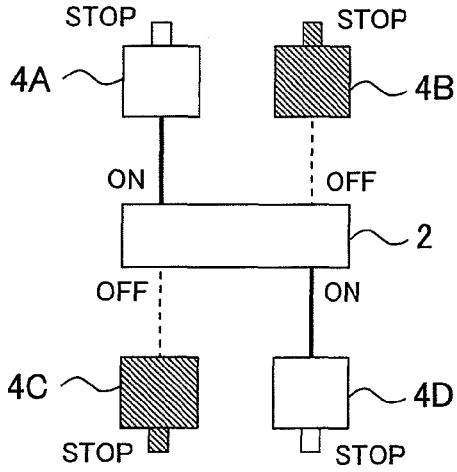
FIG. 3 is an illustration of the valve stopping device shown in FIG. 1 which indicates the output signal settings of a control device to stop all cylinders and the operating states of each actuator of this case.

FIG. 3 depicts the case where all cylinders are stopped and indicates the output signal settings of the control device 2 and the operating states of the actuators 4A, 4B, 4C, 4D. In this case, the signals to be output to the type 1 actuators 4A, 4D are on, whereas the signals to be output to the type 2 actuators 4B, 4C are off. This setup stops all cylinder valves in the closed state.

Figure 4:
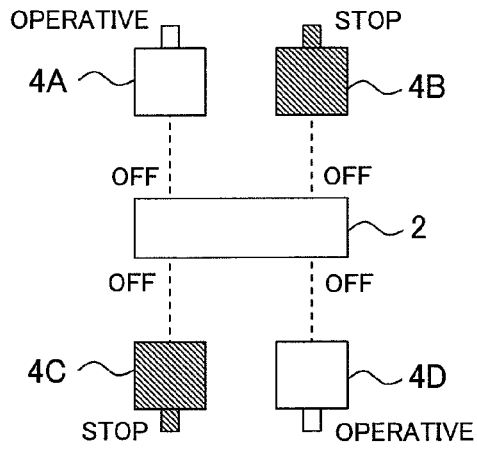
FIG. 4 is an illustration of the valve stopping device shown in FIG. 1 which indicates an example of the output signal settings of a control device to stop some of the cylinders and the operating states of each actuator of this case.
Figure 5:
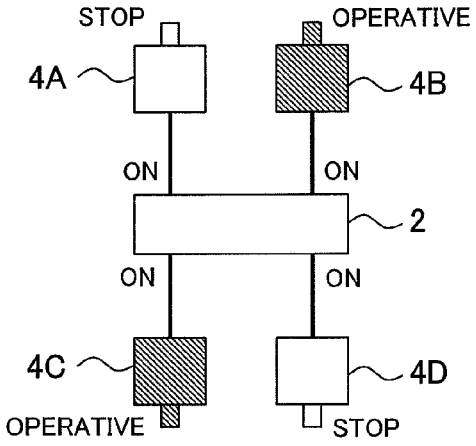
FIG. 5 is an illustration of the valve stopping device shown in FIG. 1 which indicates an example of the output signal settings of a control device to stop some of the cylinders and the operating states of each actuator of this case.

FIGS. 4 and 5 depict the case where some of the cylinders are stopped and indicate the output signal settings of the control device 2 and the operating states of the actuators 4A, 4B, 4C, 4D. In the case shown in FIG. 4, the signals to be output to all actuators 4A, 4B, 4C, 4D are off. When this setup is employed, cylinders for which the type 2 actuators 4B, 4C are provided are stopped, whereas cylinders for which the type 1 actuators 4A, 4D are provided are operative. In the case shown in FIG. 5, in contrast, the signals to be output to all actuators 4A, 4B, 4C, 4D are on. When this setup is employed, cylinders for which the type 1 actuators 4A, 4D are provided are stopped, whereas cylinders for which the type 2 actuators 4B, 4C are provided are operative.

Combinations of some of the cylinders to be stopped are not limited to those indicated in FIGS. 4 and 5. The control device 2 provides control on an individual actuator basis to determine whether or not to energize the actuators. Therefore, for example, the actuator 4A and the actuator 4B, which are of different types, can be stopped. It is also possible to stop only the actuator 4A or operate only the actuator 4A.

The valve stopping device according to the present embodiment includes the type 1 actuators, which stop a valve when energized; and type 2 actuators, which stop a valve when de-energized. This is an effective countermeasure when the valve stopping device is faulty, or more particularly, when the control device 2 is faulty, as to be described below.

Figure 7:
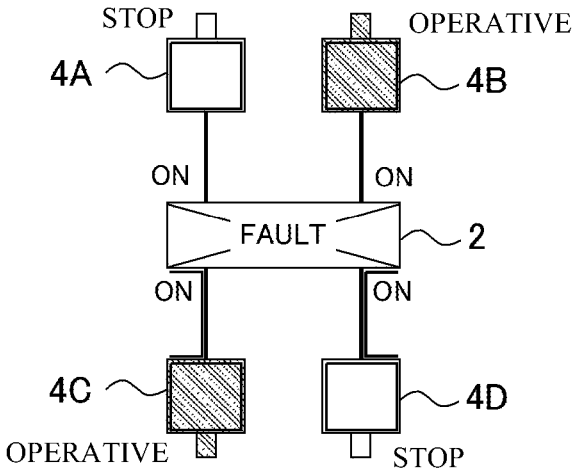
FIG. 7 is an illustration of the valve stopping device shown in FIG. 1 which indicates the output signal of the case where a control device is faulty and the operating states of each actuator of this case.

When the control device 2 is faulty, the electrical signals to be output to the actuators 4A, 4B, 4C, 4D stay on or stay off. FIG. 7 shows the operating states of the actuators 4A, 4B, 4C, 4D that prevail when the output signals of the control device 2 stay on due to a fault. In this instance, the valves for cylinders for which the type 1 actuators 4A, 4D are provided are erroneously stopped, whereas the valves for cylinders for which the type 2 actuators 4B, 4C are provided are kept operative. In this instance, therefore, the internal combustion engine can be continuously operated by the cylinders for which the type 2 actuators 4B, 4C are provided.

Figure 6:
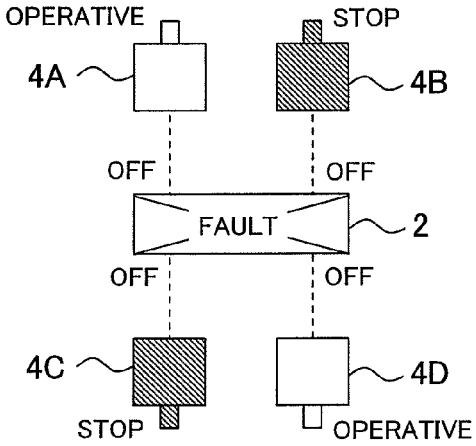
FIG. 6 is an illustration of the valve stopping device shown in FIG. 1 which indicates the output signal of the case where a control device is faulty and the operating states of each actuator of this case.

FIG. 6 shows the operating states of the actuators 4A, 4B, 4C, 4D that prevail when the output signals of the control device 2 stay off due to a fault. In this instance, the valves for cylinders for which the type 2 actuators 4B, 4C are provided are erroneously stopped, whereas the valves for cylinders for which the type 1 actuators 4A, 4D are provided are kept operative. In this instance, therefore, the internal combustion engine can be continuously operated by the cylinders for which the type 1 actuators 4A, 4D are provided.

As described above, the valve stopping device according to the present embodiment does not allow the valves for all cylinders to stop in the closed state even when the signals to be output from the control device 2 stay on or stay off due to a fault. Therefore, some cylinders enable the internal combustion engine to operate continuously. Thus, the vehicle will not be unable to run.

Second Embodiment

A second embodiment of the present invention will now be described with reference to FIGS. 8 to 12.

Figure 8:
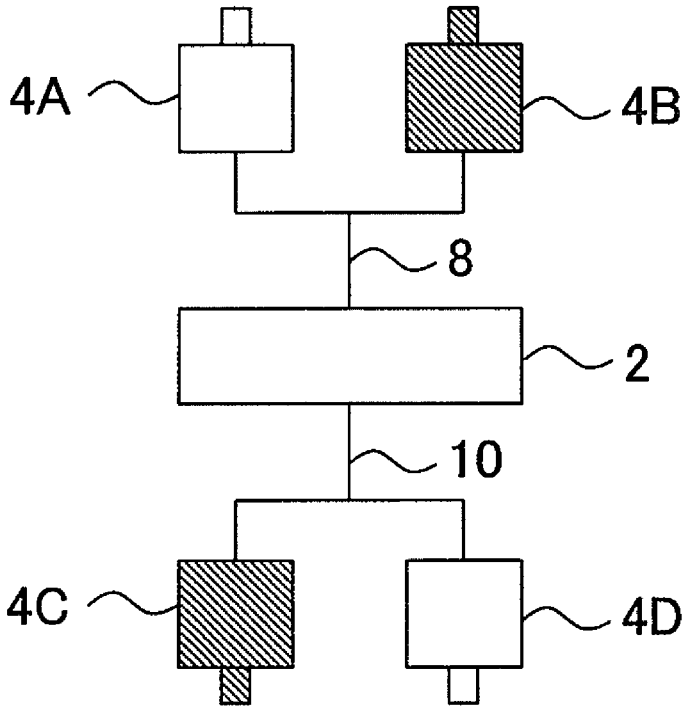
FIG. 8 is a schematic diagram illustrating a configuration of a valve stopping device for an internal combustion engine according to a second embodiment of the present invention.

FIG. 8 is a schematic diagram illustrating the configuration of the valve stopping device according to the second embodiment. In FIG. 8, elements identical with those in FIGS. 1 to 7 are designated by the same reference numerals as the corresponding elements. The valve stopping device according to the present embodiment includes a control device 2 and four actuators 4A, 4B, 4C, 4D, which are respectively provided for four cylinders. In the present embodiment, however, the actuators 4A, 4B are paired and connected to the control device 2 through a shared signal line 8. Further, the actuators 4C, 4D are paired and connected to the control device 2 through a shared signal line 10.

One of the paired actuators is the aforementioned type 1 actuator, and the remaining one is the type 2 actuator. The two actuators are provided for cylinders whose crank angles are in opposite phase to each other. When the crank angles are in opposite phase to each other, valve stop instruction periods of the two actuators do not overlap with each other. The valve stop instruction period is a minimum required period during which a signal (an ON signal for the type 1 actuator or an OFF signal for the type 2 actuator) needs to be output to an actuator to stop a valve. The valve stop instruction period not only varies depending on what mechanical or electrical scheme is included in the actuator, but also varies depending on which valve is to be stopped. In the present embodiment, it is assumed that an intake valve is to be stopped, and that the valve stop instruction period is equivalent to a possible period during which the intake valve is to be open when it is not to be stopped.

In the present embodiment, the actuators 4A, 4B share the same signal line 8. Therefore, the control device 2 supplies the same signal to the actuators 4A, 4B. Similarly, the actuators 4C, 4D share the same signal line 10. Therefore, the control device 2 supplies the same signal to the actuators 4C, 4D. In the present embodiment, the control device 2 changes the number of operative cylinders of the internal combustion engine by providing control on an individual shared signal line basis to determine whether or not to energize the actuators 4A, 4B, 4C, 4D.

The output signal setting of the control device 2 that varies with the number of operative cylinders will now be described with reference to the actuators 4A, 4B, which share the signal line 8. In the following description, a cylinder for which the actuator 4A is provided is called cylinder A, and a cylinder for which the actuator 4B is provided is called cylinder B. It is also assumed in the following description that the output signal of the control device 2 is a signal to be supplied to the actuators 4A, 4B through the shared signal line 8.

FIG. 9 depicts the case where cylinders A and B are to be both operated and illustrates the relationship between individual strokes of cylinders A and B and the output signal settings of the control device 2. As shown in FIG. 9, the crank angles of cylinders A and B are in opposite phase to each other, namely, different by a half cycle (360°). Such a cylinder combination is a combination of a first cylinder and a fourth cylinder or a combination of a second cylinder and a third cylinder when the ignition sequence of the internal combustion engine is 1-3-4-2. In such an instance, the signal turns off immediately before cylinder A begins its intake stroke, and turns on immediately before cylinder B begins its intake stroke. The intake valves of cylinders A and B can be both operated by making such a signal change on a periodic basis. For ease of explanation, it is assumed that the period during which the intake valve is open, that is, the valve stop instruction period, is equal to the period of the intake stroke.

FIG. 10 depicts the case where cylinders A and B are to be both stopped and illustrates the relationship between individual strokes of cylinders A and B and the output signal settings of the control device 2. In this case, the signal turns on immediately before cylinder A begins its intake stroke, and turns off immediately before cylinder B begins its intake stroke. The intake valves of cylinders A and B can be both stopped by making such a signal change on a periodic basis.

FIGS. 11 and 12 depict the cases where a certain cylinder is to be stopped and illustrate the relationship between individual strokes of cylinders A and B and the output signal settings of the control device 2. In the case shown in FIG. 11, the signal stays on. When this setup is employed, cylinder A for which the type 1 actuator 4A is provided can be stopped while cylinder B for which the type 2 actuator 4B is provided is operated. In the case shown in FIG. 12, in contrast, the signal stays off. When this setup is employed, cylinder B for which the type 2 actuator 4B is provided can be stopped while cylinder A for which the type 1 actuator 4A is provided is operated.

In the valve stopping device according to the present embodiment, a type 1 actuator, which stops a valve when energized, and a type 2 actuator, which stops a valve when de-energized, are paired in such a manner that their valve stop instruction periods do not overlap with each other, and connected to the control device 2 through a shared signal line. This is an effective countermeasure when the valve stopping device is faulty, or more particularly, when the control device 2 is faulty, as to be described below.

If the output signal of the control device 2 stays off due to a fault, the signal to be output to the shared signal lines 8, 10 stays off. The same holds true when the shared signal lines 8, 10 are broken. In this instance, the valves for cylinders for which the type 2 actuators 4B, 4C are provided are erroneously stopped; however, the valves for cylinders for which the type 1 actuators 4A, 4C are provided are kept operative. In this instance, therefore, the internal combustion engine can be continuously operated by the cylinders for which the type 1 actuators 4A, 4D are provided.

If, in contrast, the output signal of the control device 2 stays on due to a fault, the signal to be output to the shared signal lines 8, 10 stays on. The same holds true when foreign matter is caught in a switch that changes the signal to be output to the shared signal lines 8, 10. In this instance, the valves for cylinders for which the type 1 actuators 4A, 4D are provided are erroneously stopped; however, the valves for cylinders for which the type 2 actuators 4B, 4C are provided are kept operative. In this instance, therefore, the internal combustion engine can be continuously operated by the cylinders for which the type 2 actuators 4B, 4C are provided.

As described above, the valve stopping device according to the present embodiment does not allow the valves for all cylinders to stop in the closed state even when the signals to be output from the control device 2 stay on or stay off due to a fault. Therefore, some cylinders enable the internal combustion engine to operate continuously. Thus, the vehicle will not be unable to run.

Other

While the present invention has been described in terms of preferred embodiments, it should be understood that the present invention is not limited to those preferred embodiments. The present invention extends to various modifications that nevertheless fall within the scope and spirit of the present invention.

In the foregoing embodiments, it is assumed that the present invention is applied to a four-cylinder engine. However, the present invention can also be applied to an internal combustion engine having a larger number of cylinders or an internal combustion engine having a smaller number of cylinders. Further, in the present invention, or more specifically, in the first aspect of the present invention, the number of cylinders provided with the type 1 actuator need not always be equal to the number of cylinders provided with the type 2 actuator. Therefore, the present invention, or more specifically, the first aspect of the present invention is also applicable to an internal combustion engine having an odd number of cylinders, such as three or five cylinders.

In the second embodiment, it is assumed that the actuators for cylinders whose crank angles differ by 360° are paired. However, actuators may be paired as far as their valve stop instruction periods do not overlap with each other. Therefore, when the actuators to be paired are such that the intake valve opening period is equal to the valve stop instruction period, the actuators for cylinders whose crank angles differ by 240° may be paired for a six-cylinder engine, and the actuators for cylinders whose crank angles differ by 270° may be paired for an eight-cylinder engine.

DESCRIPTION OF REFERENCE NUMERALS

2 Control device
4A, 4D Type 1 actuator
4B, 4C Type 2 actuator
6A, 6B, 6C, 6D Signal line
8, 10 Shared signal line

The invention claimed is:

1. A valve stopping device for an internal combustion engine that is capable of stopping either an intake valve or an exhaust valve of the internal combustion engine having a plurality of cylinders on an individual cylinder basis or on an individual cylinder group basis, the valve stopping device comprising:

actuators that are provided for some of the plurality of cylinders to stop a valve in the closed state when energized;

actuators that are provided for the remaining ones of the plurality of cylinders to stop a valve in the closed state when de-energized; and a control device that provides control on an individual actuator basis to determine whether or not to energize the actuators.

2. A valve stopping device for an internal combustion engine that is capable of stopping either an intake valve or an exhaust valve of the internal combustion engine having a plurality of cylinders on an individual cylinder basis or on an individual cylinder group basis, the valve stopping device comprising:

actuators that are provided for some of the plurality of cylinders to stop a valve in the closed state when energized for a predetermined valve stop instruction period (hereinafter referred to as the type 1 actuators);

actuators that are provided for the remaining ones of the plurality of cylinders to stop a valve in the closed state when de-energized for a predetermined valve stop instruction period (hereinafter referred to as the type 2 actuators);

shared signal lines that are shared by one type 1 actuator and one type 2 actuator, the valve stop instruction period of the type 1 actuator not overlapping with the valve stop instruction period of the type 2 actuator; and a control device that provides control on an individual shared signal line basis to determine whether or not to energize the actuators.

* * * * *